US006405014B2

(12) United States Patent
Takano et al.

(10) Patent No.: US 6,405,014 B2
(45) Date of Patent: Jun. 11, 2002

(54) FIXING DEVICE FOR FIXING A DEVELOPER IMAGE ON A RECORDING MEDIUM BY INDUCTION-HEATING A HEAT ROLLER

(75) Inventors: Kenji Takano; Taizo Kimoto, both of Tokyo; Noiryuki Umezawa, Yokohama; Hisaaki Kawano, Chigasaki; Hiroshi Nakayama, Kawasaki; Osamu Takagi; Satoshi Kinouchi, both of Tokyo; Kazuhiko Kikuchi; Masahiko Ogura, both of Yokohama, all of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/939,563

(22) Filed: Aug. 28, 2001

Related U.S. Application Data

(63) Continuation of application No. PCT/JP99/07406, filed on Dec. 28, 1999.

(51) Int. Cl.[7] ..... G03G 15/20

(52) U.S. Cl. ..... 399/330; 174/35 CE; 361/816; 399/328

(58) Field of Search ..... 399/330, 328, 399/320, 67; 219/216, 619; 361/816, 817; 174/35 R, 35 CE

(56) References Cited

U.S. PATENT DOCUMENTS

| | | | | | |
|---|---|---|---|---|---|
| 4,647,714 | A | * | 3/1987 | Goto | 174/35 R X |
| 5,526,103 | A | | 6/1996 | Kato et al. | 399/328 |
| 6,054,647 | A | * | 4/2000 | Ridener | 361/816 X |
| 6,097,926 | A | * | 8/2000 | Takagi et al. | 399/328 |

FOREIGN PATENT DOCUMENTS

| | | | |
|---|---|---|---|
| JP | 57-97562 | | 6/1982 |
| JP | 64-76696 | | 3/1989 |
| JP | 10-074009 | * | 3/1998 |
| JP | 11-126678 | | 5/1999 |

* cited by examiner

*Primary Examiner*—Sophia S. Chen
(74) *Attorney, Agent, or Firm*—Foley & Lardner

(57) ABSTRACT

A high-frequency current is supplied from a high-frequency generating circuit to a coil of a heat roller, and a high-frequency magnetic field is generated from the coil. The high-frequency magnetic field causes an eddy current to be generated in the heat roller, and a developer image on a recording medium is fixed by self-generation of heat of the heating roller based on an eddy-current loss. Electric wires between the high-frequency generating circuit and the coil are electrically shielded by a shield member.

9 Claims, 9 Drawing Sheets

FIXING DEVICE FOR FIXING A DEVELOPER IMAGE ON A RECORDING MEDIUM BY INDUCTION-HEATING A HEAT ROLLER

CROSS REFERENCE TO RELATED APPLICATIONS

This is a Continuation Application of PCT Application No. PCT/JP99/07406, filed Dec. 28, 1999, which was not published under PCT Article 21(2) in English.

BACKGROUND OF THE INVENTION

1. Field of the Invention

The present invention relates to a fixing device in which a high-frequency magnetic field is generated from a coil, the high-frequency magnetic field is applied to a heating member, thereby generating an eddy current in the heating member, and a developer image on a recording medium is fixed by self-generation of heat of the heating member based on an eddy-current loss.

2. Description of the Related Art

In an image forming apparatus utilizing digital technology, such as a so-called electronic copying machine, a document stage on which an original document is placed is exposed, and an image signal corresponding to the amount of light reflected from the document stage is obtained from a line sensor of CCD (charge coupled device) type. Laser beam corresponding to the image signal obtained from the line sensor is radiated on a photosensitive drum, thereby forming an electrostatic latent image on a peripheral surface of the photosensitive drum. The electrostatic latent image is developed by adhesion of a (negatively) precharged developer (toner). A paper sheet is carried to the photosensitive drum in synchronism with the rotation of the photosensitive drum. The developed image (developer image) on the photosensitive drum is transferred to the paper sheet. Then, the paper sheet on which the developer image has been transferred is fed to a fixing device.

The fixing device has a heat roller, and a press roller in contact with the heat roller. A paper sheet is inserted between the two rollers. While the paper sheet is being conveyed by the rollers, the developer image on the paper sheet is fixed by heat of the heat roller.

An induction-heating device is an example of the heat source of the heat roller. The induction-heating device comprises a coil held inside the heat roller and a high-frequency generating circuit for supplying a high-frequency current to the coil.

The high-frequency generating circuit comprises a rectifying circuit for rectifying a voltage of an AC power source and a switching circuit for converting the output voltage (DC voltage) of the rectifying circuit to a high-frequency voltage of a predetermined frequency. The aforementioned coil is connected to an output terminal of the high-frequency generating circuit (an output terminal of the switching circuit).

When the high-frequency generating circuit operates, a high-frequency current is supplied to the coil, with the result that a high-frequency magnetic field is generated from the coil. The high-frequency magnetic field is applied to the heat roller, and an eddy current is generated in the heat roller. Then, the heat roller is self-heated owing to an eddy current loss. The developer image on the paper sheet is fixed by the heat.

An electric wire (a so-called lead) lies between the high-frequency generating circuit and the coil. The high-frequency magnetic field generated from the electric wire may influence another part existing around the electric wire, resulting in a possibility of unnecessary heat generation of the part.

BRIEF SUMMARY OF THE INVENTION

The present invention was made in consideration of the above situations. An object of the present invention is to overcome the drawback that the high-frequency magnetic field may adversely influence another part.

A fixing device according to the present invention having a coil in a heat roller, causing the coil to generate a high-frequency magnetic field, thereby generating an eddy current in the heat roller, and fixing a developer image on a recording medium by self-generation of heat of the heat roller based on an eddy-current loss, the fixing device comprising:

- a high-frequency generating circuit for outputting a high-frequency current to generate a high-frequency magnetic field from the coil;
- an electric wire for supplying the output of the high-frequency generating circuit to the coil; and
- a shield member for magnetically shielding the electric wire.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION (1) A first embodiment of the present invention will be described below.

Figure 1:
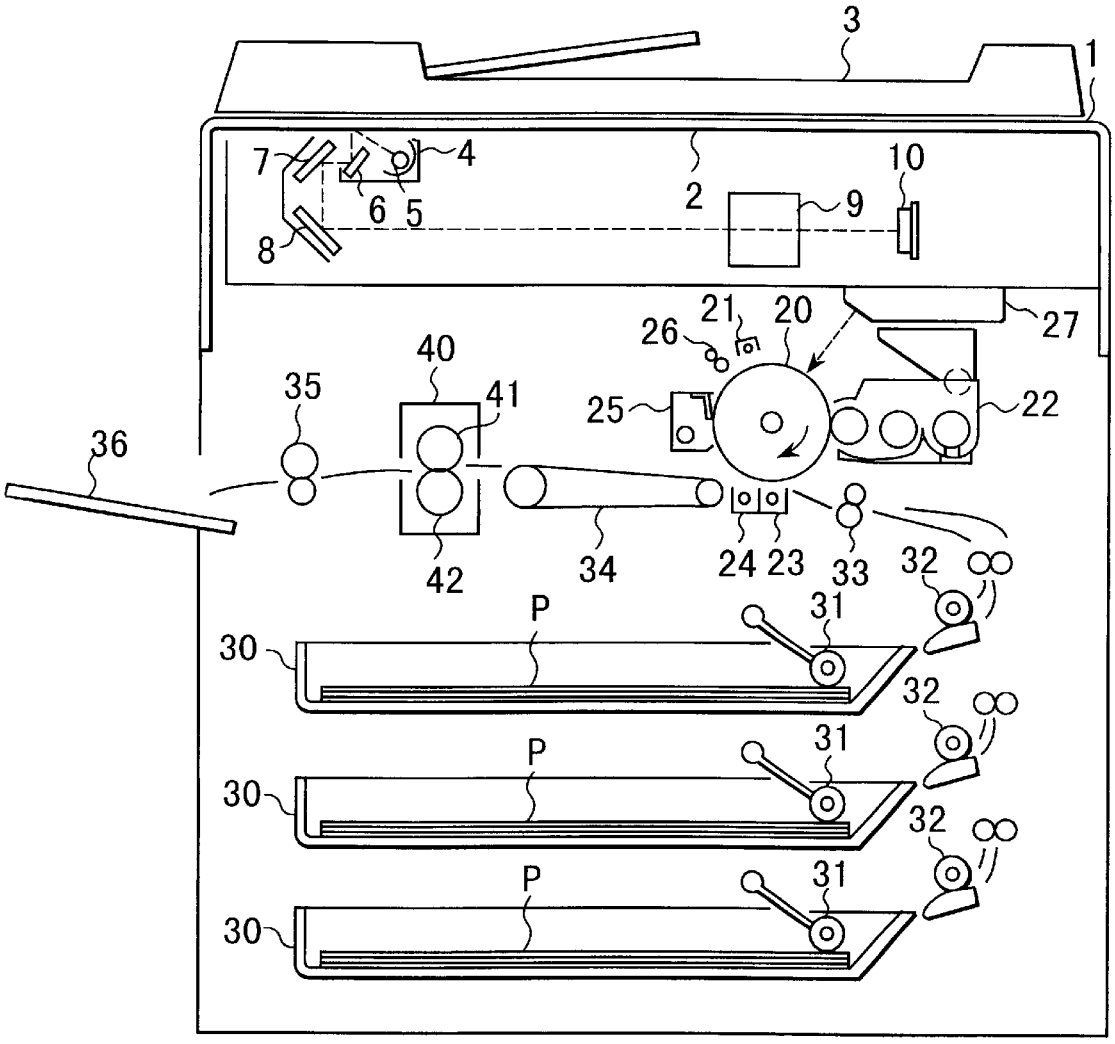
FIG. 1 is a diagram showing the overall structure of an electronic copying machine according to embodiments.

FIG. 1 shows an internal structure of an image forming apparatus, for example, an electronic copying machine.

A document stage 2 on which an original document is placed is located above a main body 1. An automatic document feeder 3 is provided above the document stage 2. The automatic document feeder 3 automatically feeds original documents one by one to the upper surface of the document stage 2.

A carriage 4, capable of reciprocating, is provided under the document stage 2. The carriage 4 has an exposure lamp 5. As the carriage 4 reciprocates while the exposure lamp 5 illuminates, the overall surface of the document stage 2 is exposed and scanned.

By the exposure and scanning, a reflected light image of the original document placed on the document stage is obtained. The reflected light image is projected on a line sensor 10 of CCD (charge coupled device) type (hereinafter referred to as a CCD sensor) via reflection mirrors 6, 7 and 8 and a scaling lens block 9. The CCD sensor 10 outputs an image signal of a voltage level corresponding to the amount of received light. The image signal is sent to a laser unit 27. The laser unit 27 emits a laser beam corresponding to the image signal.

A photosensitive drum 20 is rotatably provided in the main body 1. An electricity charger 21, a developing device 22, a transferring charger 23, a peeling charger 24, a cleaner 25 and an electricity removing device 26 are sequentially arranged around the photosensitive drum 20. The laser beam emitted from the laser unit 27 passes between the electricity charger 21 and the developing device 22, and irradiates the peripheral surface of the photosensitive drum.

A plurality of paper feed cassettes 30 are located in a lower portion of the main body 1. Each paper feed cassette 30 contains a number of recording media, e.g., copying paper sheets P.

A pickup roller 31 for picking up copying paper sheets P one by one is provided for each paper feed cassette 30.

In a copying operation, copying paper sheets P are picked up one by one from one of the paper feed cassettes 30. The picked up paper sheet P is separated from the paper feed cassette 30 by a separator 32, conveyed to a resist roller 33, and stands by there for rotation of the photosensitive drum 20. The resist roller 33 sends the copying paper sheet P to a gap between the transferring charger 23 and the photosensitive drum 20 in synchronism with the rotation of the photosensitive drum 20.

The photosensitive drum 20 rotates clockwise in the copying operation as shown in the drawing. The electricity charger 21 applies a high voltage, supplied from a high voltage source (not shown), to the photosensitive drum 20, so that the surface of the photosensitive drum 20 is charged with static electricity. This electricity charge and the radiation of the laser beam from the laser unit 27 to the photosensitive drum 20 form an electrostatic image on the photosensitive drum 20.

The developing device 22 supplies a developer to the photosensitive drum 20. The supply of the developer causes the electrostatic latent image on the photosensitive drum 20 to be developed. The transferring charger 23 transfers the developed image (developer image) on the photosensitive drum 20 to the copying paper sheet P sent from the resist roller 33. The copying paper sheet P, after the transference, was peeled off from the photosensitive body 20 by the peeling charger 24. The peeled copying paper sheet P is sent to a fixing device 40 by a conveyor belt 34.

The fixing device 40 has a heat roller 41 and a press roller 42. The copying paper sheet P is inserted between the two rollers. While the copying paper sheet P is being conveyed by the rollers, the developer image on the copying paper sheet P is fixed by heat of the heat roller. The copying paper sheet P that has passed the fixing device 40 is ejected to a tray 36 by a conveyor roller 35.

Figure 2:
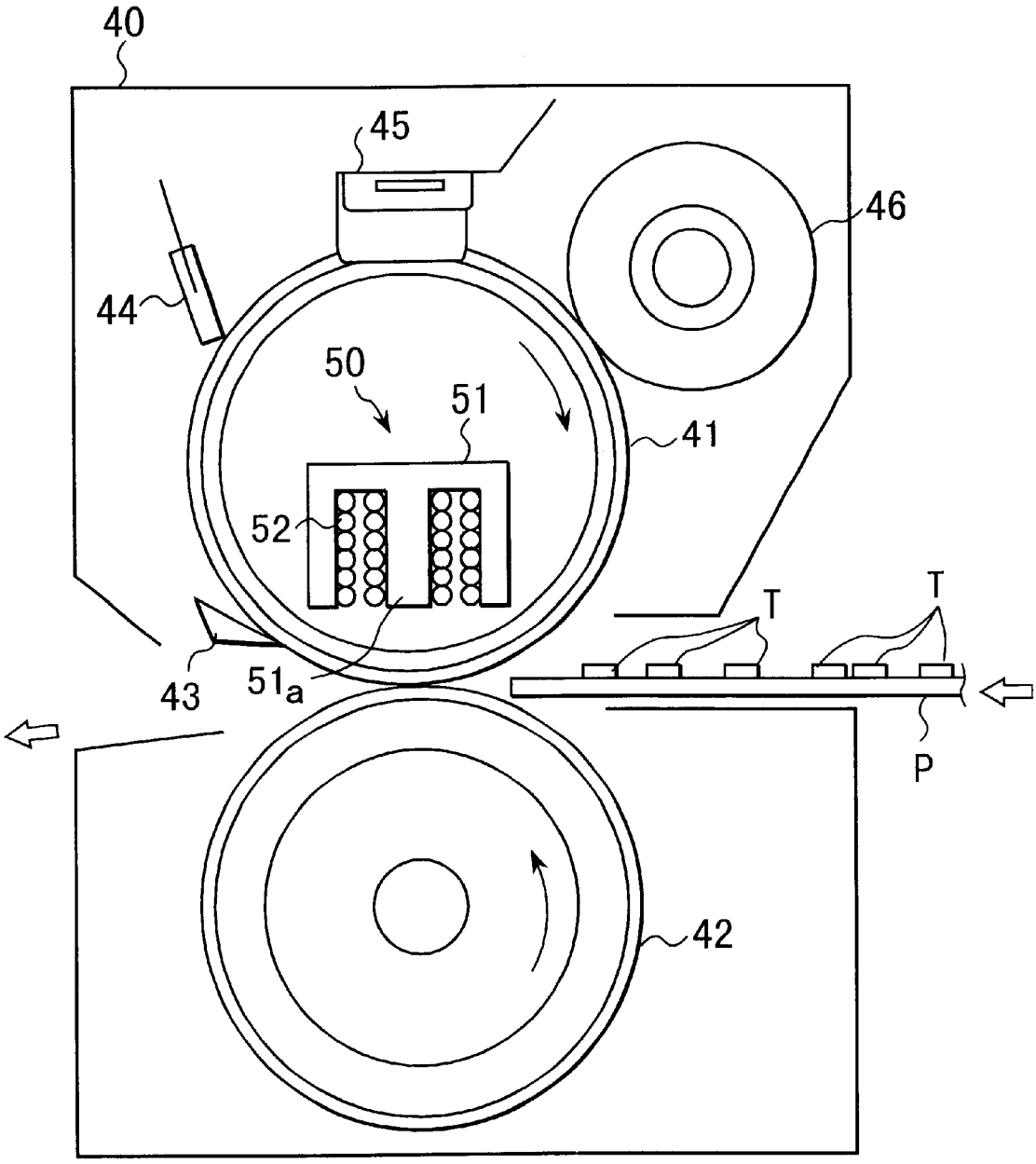
FIG. 2 is a diagram showing the structure of the embodiments.

A detailed structure of the fixing device 40 is shown in FIG. 2.

The conductive heat roller 41 and the press roller 42, which is rotatably pressed against the heat roller 41, are located at positions sandwiching the transfer path of the copying paper sheet P. The contact portion between the rollers 41 and 42 is kept to a fixed nip width.

The heat roller 41 is rotated in the direction of the arrow. The press roller 42 is rotated in the direction of the arrow in accordance with the rotation of the heat roller 41. The copying paper sheet P passes through the contact portion (fixing point) between the heat roller 41 and the press roller 42, and the copying paper sheet P receives heat from the heat roller 41. As a result, the developer image T on the copying paper sheet P is fixed to the copying paper sheet P.

A peeling claw 43 for peeling the copying paper sheet P from the heat roller 41, a cleaning member 44 for removing dust, such as toner and paper chips, remaining on the heat roller 41, a thermistor 45 for detecting a surface temperature Tr of the heat roller 41 and a mold release agent-applying device 46 for applying a mold release agent to the surface of the heat roller 41 are arranged around the heat roller 41.

The heat roller 41 contains inside thereof an induction-heating device 50 serving as a heat source. The induction-heating device 50 comprises a core 51 and a coil 52 fitted to the core 51. The coil 52 generates a high-frequency magnetic field. The heat roller 41 is induction-heated by the high-frequency magnetic field. The core 51 comprises a center projection 51*a* on which the coil 52 is wound.

More specifically, a high-frequency current is supplied to the coil 52 from a high-frequency generating circuit 61 to be described later, with the result that a high-frequency magnetic field is generated from the coil 52. The high-frequency magnetic field causes an eddy current to be generated in the heat roller 41. The heat roller 41 is self-heated owing to an eddy current loss incurred by the eddy current and the resistance of the heat roller 41.

Figure 3:
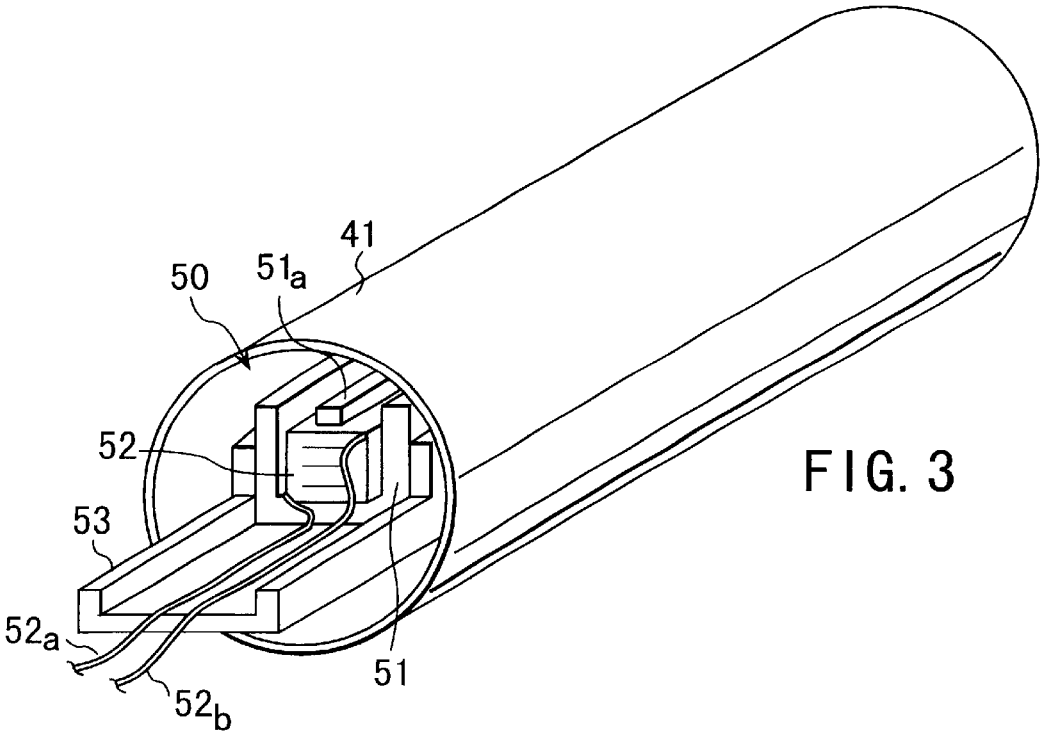
FIG. 3 is a diagram showing a main part of the embodiments.

As shown in FIG. 3, support members 53 are attached to the ends of the core 51. The support members 53 are fixed to a fixing metal plate (not shown) of the main body 1. By virtue of the support members 53, the induction-heating device 50 is supported independent of the heat roller 41.

Figure 4:
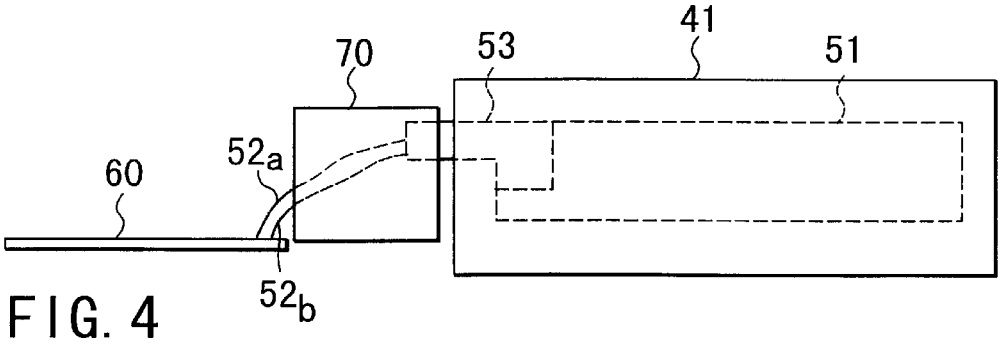
FIG. 4 is a diagram showing an arrangement of a shield member of first and second embodiments.

As shown in FIG. 4, electric wires (so-called leads) 52*a* and 52*b* are drawn out from both ends of the coil 52. The electric wires 52*a* and 52*b* are connected to a circuit board 60 on the induction-heating device side. A shield member 70 for magnetically shielding the electric wires 52*a* and 52*b* is provided to surround the electric wires 52*a* and 52*b*.

Figure 5:
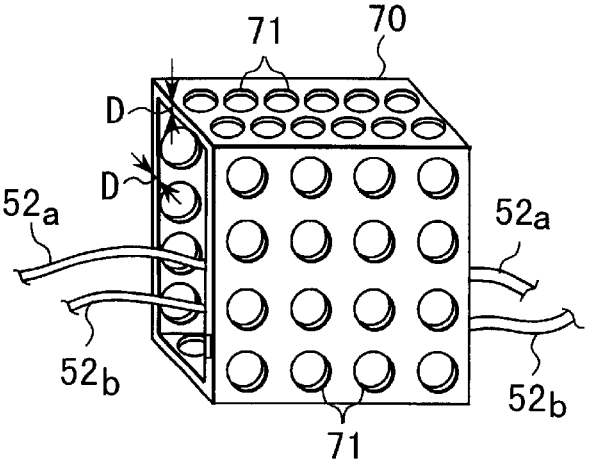
FIG. 5 is a diagram showing the structure of the shield member of the first embodiment.

The shield member 70 has a cylindrical shape as shown in FIG. 5. The width D of sides of the shield member 70 is set to a value that can provide a sufficient shield effect.

The shield member 70 has a structure that may not easily generate an eddy current even if it receives the magnetic field generated from the electric wires 52*a* and 52*b*, in particular, a number of holes 71 in the sides.

Figure 6:
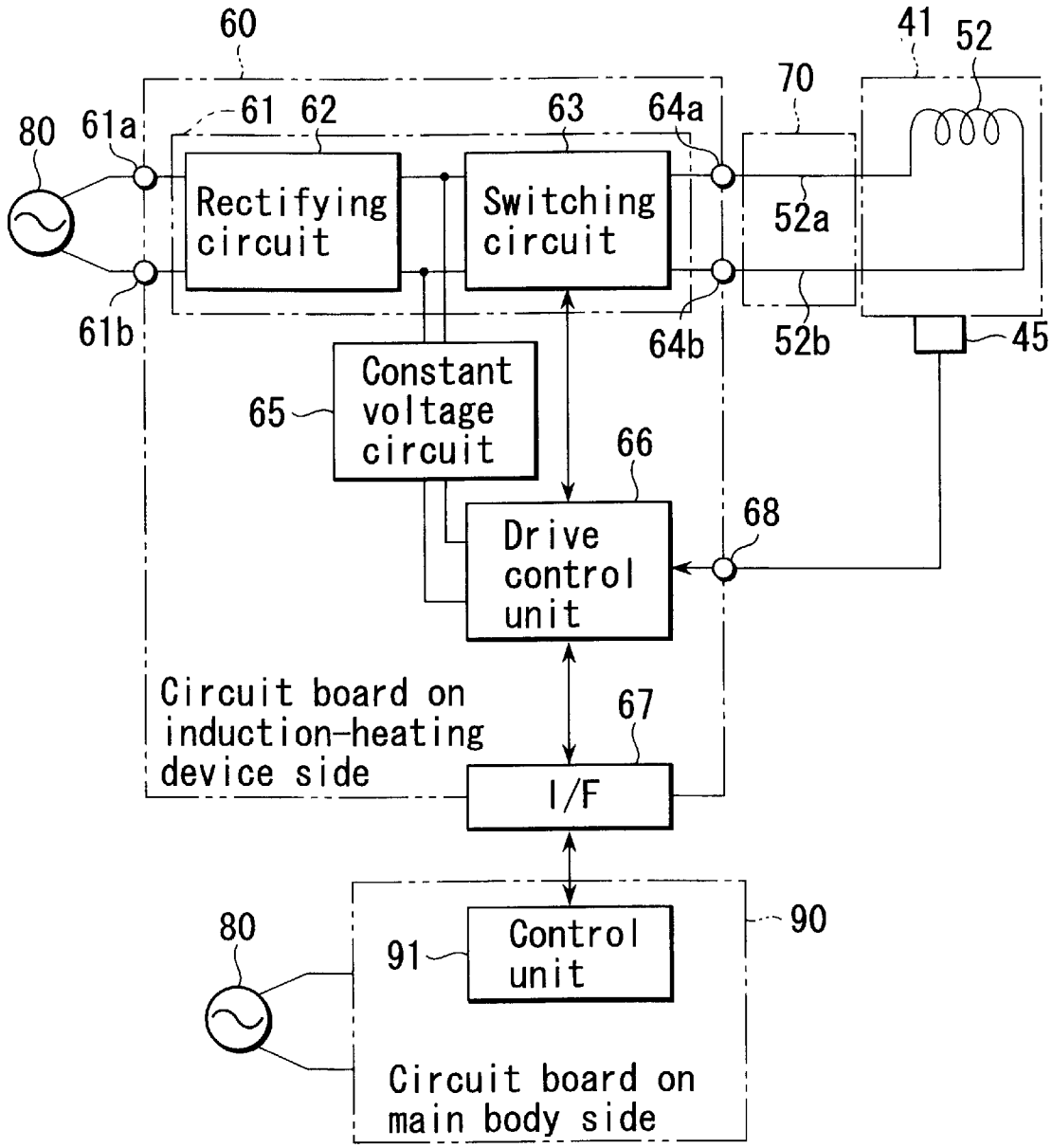
FIG. 6 is a block diagram showing electric circuits of the first embodiment.

The circuit board 60 comprises, as shown in FIG. 6, input terminals 61*a* and 61*b* connected to a commercial AC power source 80, the high-frequency generating circuit 61 connected to the input terminals 61*a* and 61*b*, output terminals 64*a* and 64*b* connected to output terminals of the high-frequency generating circuit 61, a constant voltage circuit 65 connected to the input terminals 61*a* and 61*b*, a drive control unit 66 connected to an output terminal of the constant voltage circuit 65, an interface 67 for carrying out data transmission and reception between the drive control unit 66 and a circuit board 90 on the main body side, and an input terminal 68 for entering temperature data detected by the thermistor 45 into the drive control circuit 66.

A rectifying circuit 62 rectifies the voltage of the commercial AC power source 80. A switching circuit 63 converts an output voltage (DC voltage) of the rectifying circuit 62 to a high-frequency voltage of a predetermined frequency. The constant voltage circuit 65 adjusts the output voltage of the rectifying circuit 62 to a constant level suitable for the operation of the drive control unit 66 and outputs the adjusted voltage. The drive control unit 66 controls driving of the switching circuit 63 in accordance with instructions sent from a control unit 91 of the circuit board 90 on the main body side.

The electric wires 52*a* and 52*b* are connected to the output terminals 64*a* and 64*b* of the circuit board 60.

The circuit board 90 on the main body side is connected to the commercial AC power source 80. The circuit board 90 on the main body side comprises electric circuit portions (not shown) of the main body 1, in addition to the control unit 91.

Figure 7:
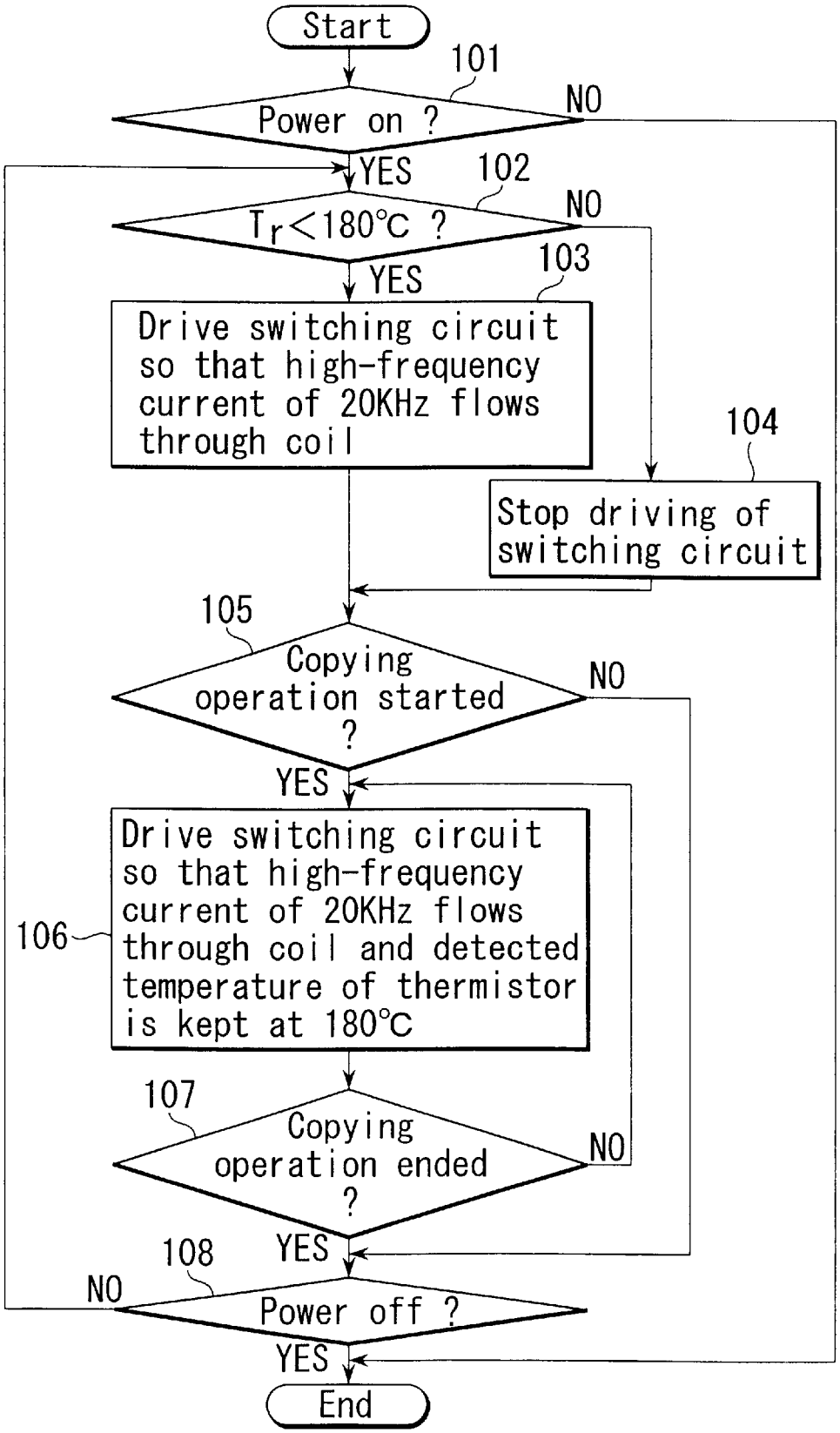
FIG. 7 is a flowchart showing a control in the embodiments.

The flowchart of FIG. 7 shows control of the control unit 91 and the drive control unit 66.

When the commercial AC power source 80 is turned on (YES in Step 101), the detected temperature in the thermistor 45 (the surface temperature of the heat roller 41) Tr is compared with the set value, for example, 180° C. (Step 102).

If the detected temperature is lower than 180° C. (YES in Step 102), the switching circuit 63 is driven so that a high-frequency current of a frequency other than 40 KHz, for example, 20 KHz, flows through the coil 52 (Step 103). Since the high-frequency magnetic field of 40 KHz has a drawback that it adversely affects the operations of the other portions in the main body 1, the generation thereof is prohibited.

If the detected temperature is equal to or higher than 180° C. (NO in Step 102), the driving of the switching circuit 63 is stopped (Step 104).

When a copying operation is started (YES in Step 105), the switching circuit 63 is driven so that the high-frequency magnetic field of 20 KHz flows through the coil 52 and the detected temperature Tr is kept at 180° C. (Step 106).

When the copying operation is ended (YES in Step 107), if the commercial AC power source 80 is on (NO in Step 108), the process starting from the above step 102 is repeated.

As described above, since the electric wires 52*a* and 52*b* are magnetically shielded by the shield member 70, even if a high-frequency magnetic field is generated from the electric wires 52*a* and 52*b*,it is possible to overcome the drawback that the high-frequency magnetic field acts on the other members and the members undesirably generate heat.

Moreover, since the shield member 70 has many holes 71 in the sides, even if it receives the magnetic field generated from the electric wires 52*a* and 52*b*,an eddy current is not easily generated. Therefore, a temperature increase in the shield member 70 is prevented. Consequently, even if a person in charge touches the shield member 70 while inspecting the interior of the main body 1, safety can be ensured.

(2) A second embodiment of the present invention will be described.

Figure 8:
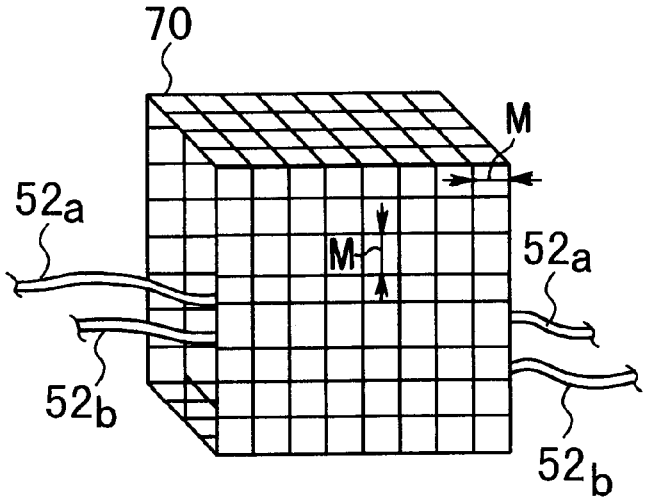
FIG. 8 is a diagram showing the structure of the shield member of the second embodiment.

As shown in FIG. 8, the sides of the shield member 70 are formed of a mesh member. The other structures are the same as those of the first embodiment.

Since the sides of the shield member 70 are formed of a mesh member, even if they receive the magnetic field generated from the electric wires 52*a* and 52*b*, an eddy current is not easily generated. In addition, the distance M between the lines of the mesh member is set to an optimum value (a value verified by experiment) such that an eddy current is not easily generated.

Therefore, a temperature increase in the shield member 70 is prevented. Consequently, even if a person in charge touches the shield member 70 while inspecting the interior of the main body 1, safety can be ensured.

(3) A third embodiment of the present invention will be described.

Figure 9:
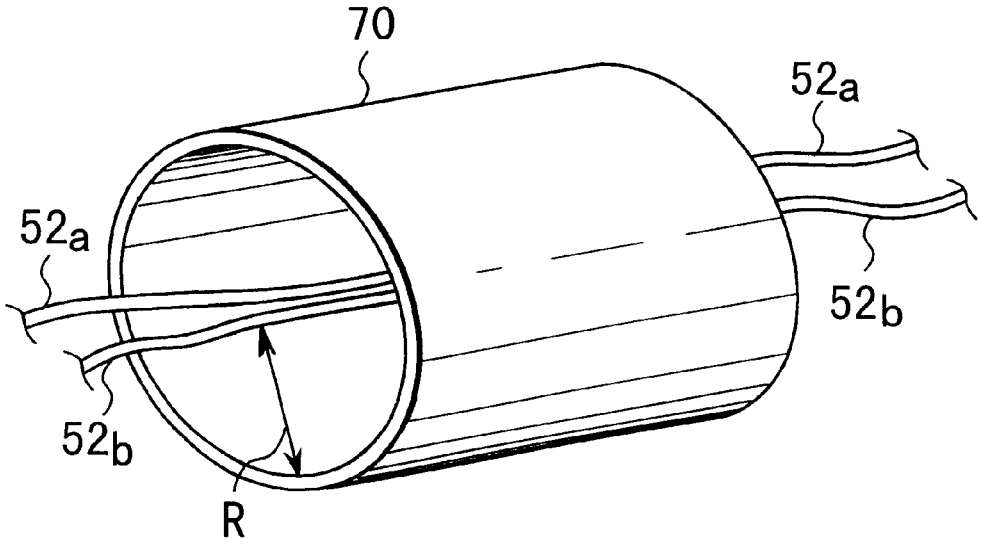
FIG. 9 is a diagram showing the structure of the shield member in a third embodiment.

A cylindrical shield member 70 as shown in FIG. 9 is employed. The shield member 70 is supported by the support members 53 such that the electric wires 52*a* and 52*b* pass a position substantially the same as the axis of the shield member 70.

Owing to this supporting, a distance R is maintained between the side surface of the shield member 70 and the electric wires 52*a* and 52*b*. The distance R is set to an optimum value (a value verified by experiment) such that an eddy current is not easily generated on the side surface of the shield member 70. The other structures are the same as those of the first embodiment.

Therefore, a temperature increase in the shield member 70 is prevented. Consequently, even if a person in charge touches the shield member 70 while inspecting the interior of the main body 1, safety can be ensured.

(4) A fourth embodiment of the present invention will be described.

Ferrite is employed as the material of the shield member 70. The other structures are the same as those of the first embodiment.

Ferrite does not easily generate an eddy current, even if it receives a high-frequency magnetic field from the electric wires 52*a* and 52*b*. Therefore, a temperature increase in the shield member 70 is prevented. Consequently, even if a person in charge touches the shield member 70 while inspecting the interior of the main body 1, safety can be ensured.

(5) A fifth embodiment of the present invention will be described.

Figure 10:
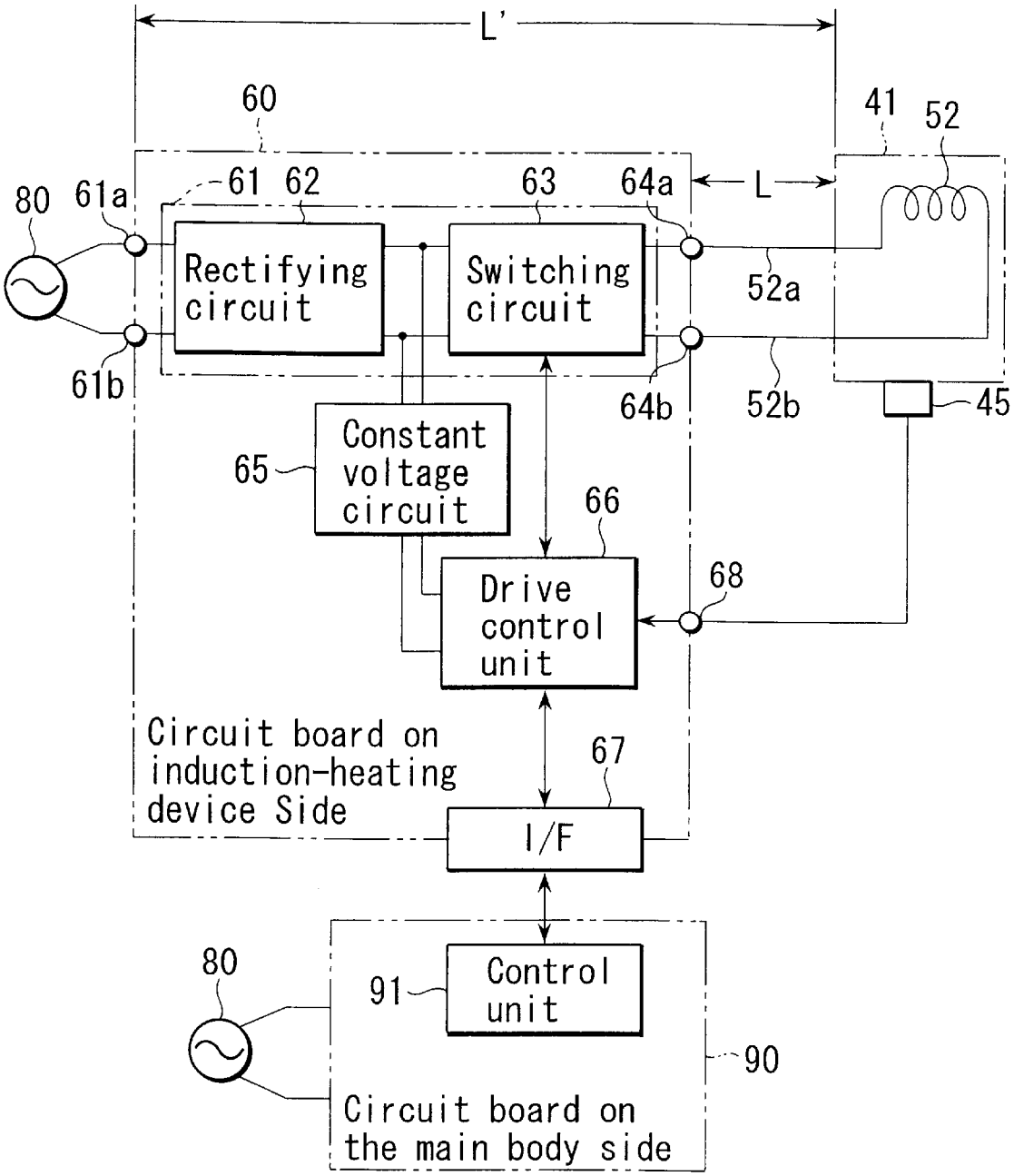
FIG. 10 is a block diagram showing electric circuits of a fifth embodiment.

As shown in FIG. 10, the electric wires 52*a* and 52*b* between the circuit board 60 and the heat roller 41 are set to a predetermined length L based on the frequency of a high-frequency current output from the high-frequency generating circuit 61. Owing to this setting of the length L, the electric wires 52*a* and 52*b* do not easily generate a magnetic field. The other structures are the same as those of the first embodiment.

The length of the conductive pattern and the electric wires 52*a* and 52*b* may be set to a predetermined length L' based on the frequency of the high-frequency current output from the high-frequency generating circuit 61. The setting of the length L makes it difficult to generate a magnetic field from the electric wires 52*a* and 52*b*.

Since a magnetic field is not easily generated from the electric wires 52*a* and 52*b*, an eddy current is not easily generated on the side surface of the shield member 70 accordingly. Therefore, the temperature increase in the shield member 70 can be prevented. Consequently, even if a person in charge touches the shield member 70 while inspecting the interior of the main body 1, safety can be ensured.

Figure 11:
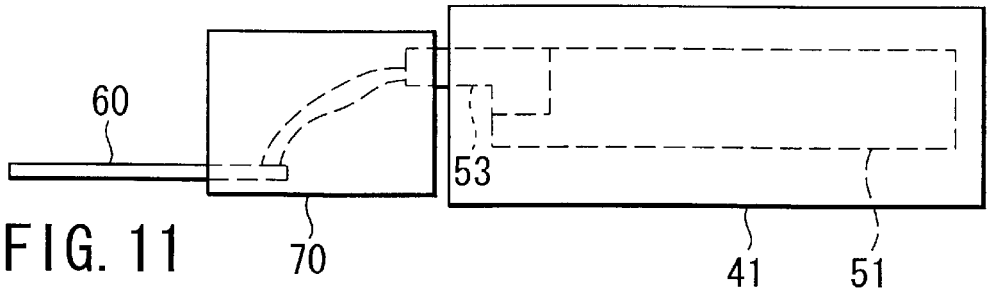
FIG. 11 is a diagram showing an arrangement of the shield member of a sixth embodiment.
Figure 12:
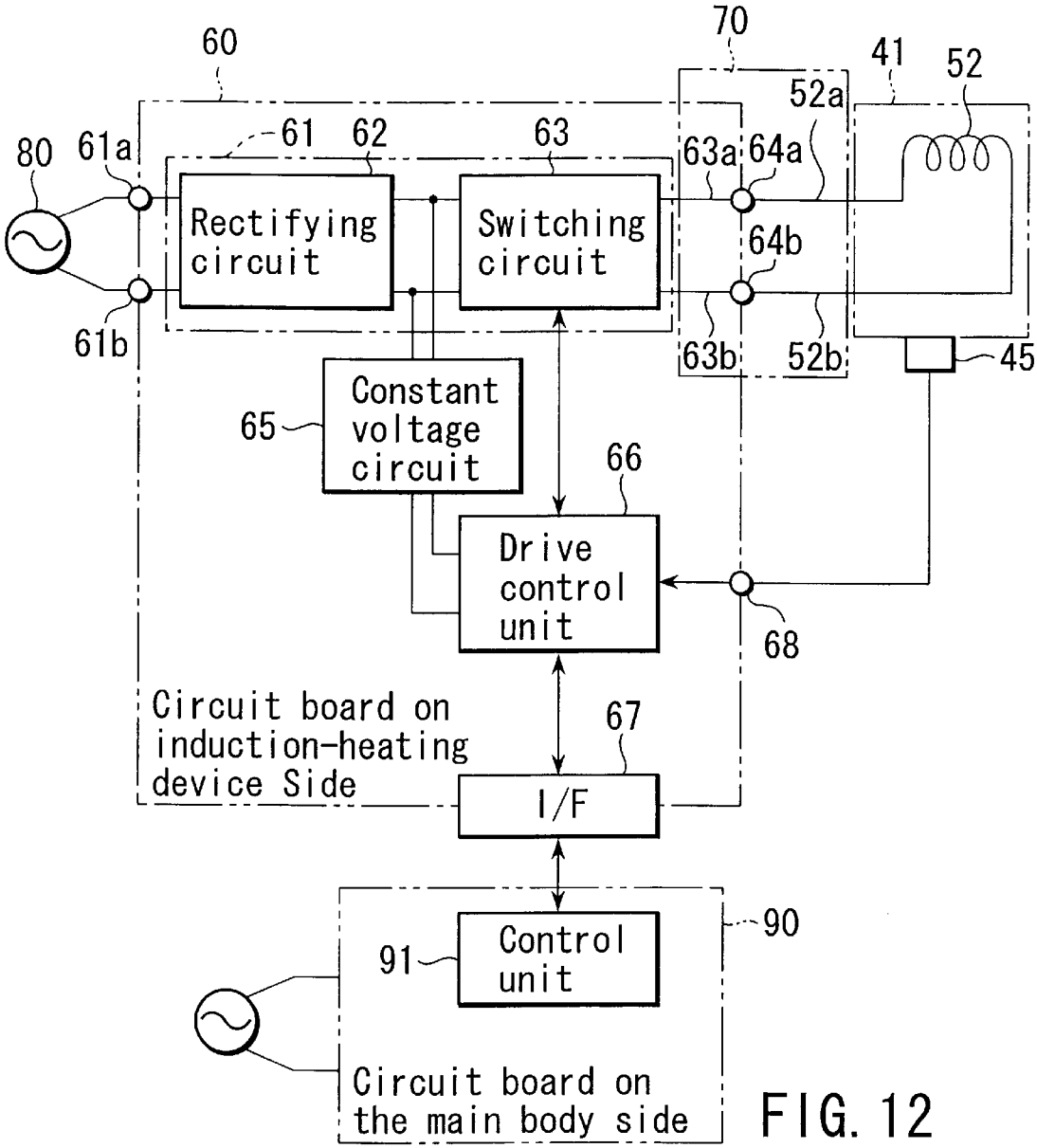
FIG. 12 is a block diagram showing electric circuits of the sixth embodiment.

(6) A sixth embodiment of the present invention will be described with reference to FIGS. 11 and 12.

The circuit board 60 has, in a part thereof, conductive patterns 63*a* and 63*b* for electrically connecting outputs of the switching circuit 63 to the output terminals 64*a* and 64*b*.

Therefore, the part of the circuit board 60 as well as the electric wires 52*a* and 52*b* is magnetically shielded by the shield member 70.

With this structure, even if a high-frequency magnetic field is generated from the wiring patterns 63*a* and 63*b* and the electric wires 52*a* and 52*b*, it is possible to overcome the drawback that the high-frequency magnetic field acts on the other members and the members undesirably generate heat.

In this case, the temperature increase in the shield member 70 can be prevented, if the shield member 70 has a number of holes 71 as in the first embodiment, the side surface of the shield member 70 is formed of a mesh member as in the second embodiment, the side surface of the shield member 70 is spaced at the distance R from the electric wires 52*a* and 52*b* as in the third embodiment, or ferrite is employed as the material of the shield member 70 as in the fourth embodiment. Consequently, even if a person in charge touches the shield member 70 while inspecting the interior of the main body 1, safety can be ensured.

(7) A seventh embodiment of the present invention will be described.

Figure 13:
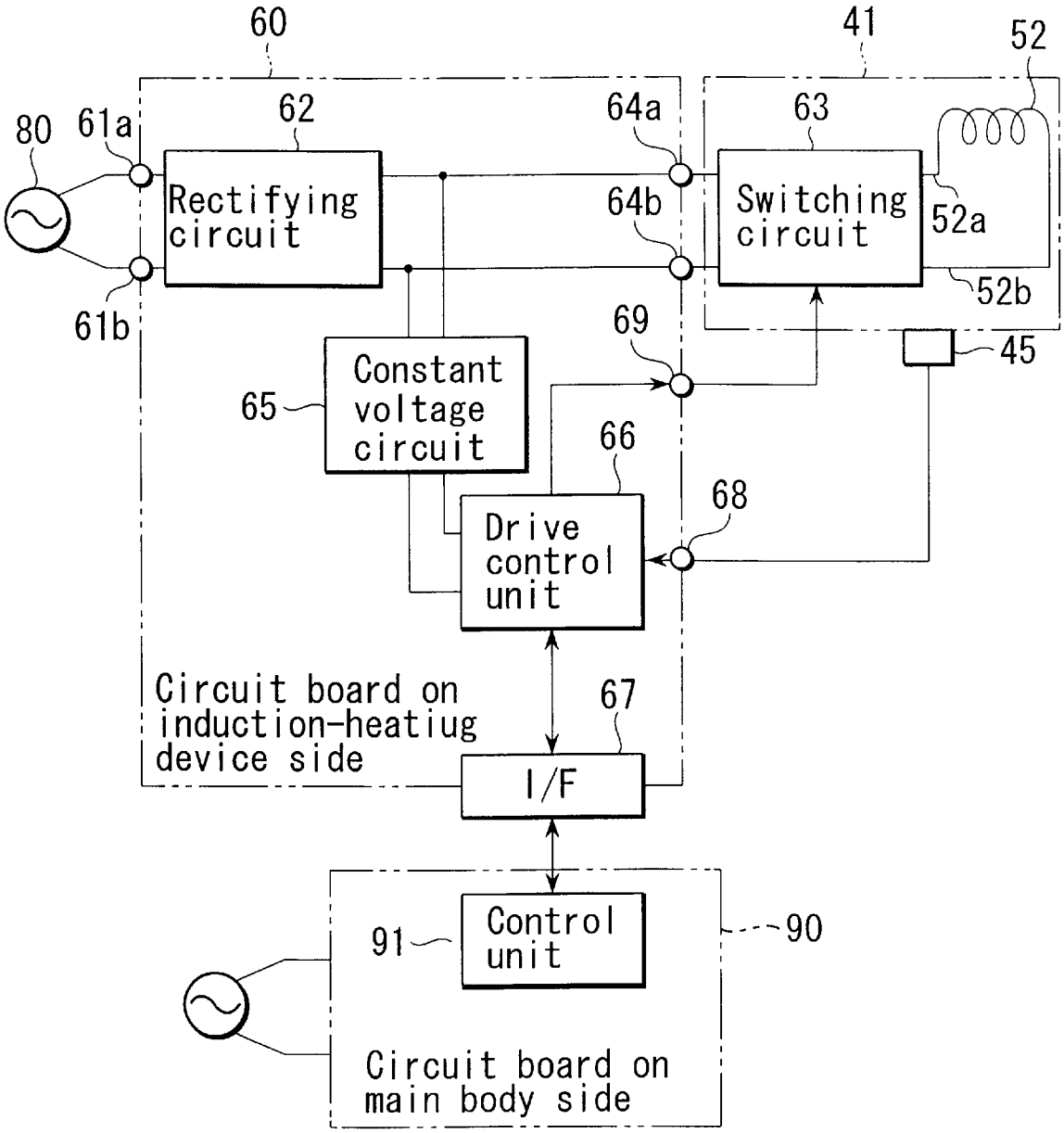
FIG. 13 is a block diagram showing electric circuits of a seventh embodiment.

As shown in FIG. 13, the switching circuit 63 is provided in the heat roller 41. As a result, the electric wires 52*a* and 52*b* are contained in the heat roller 41.

The circuit board 60 comprises an output terminal 69 for supplying a driving signal to the switching circuit 63. The switching circuit 63 is connected to the output terminal 69.

With this structure, even if a high-frequency magnetic field is generated from the switching circuit 63 and the electric wires 52*a* and 52*b*, it is possible to overcome the drawback that the high-frequency magnetic field acts on the other members and the members undesirably generate heat.

The present invention is applicable likewise to any apparatus in which a high-frequency current is supplied from a high-frequency generating circuit to a coil, and a high-frequency magnetic field is generated from the coil to induction-heat a heating member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A fixing device having a coil in a heat roller, causing the coil to generate a high-frequency magnetic field, thereby generating an eddy current in the heat roller, and fixing a developer image on a recording medium by self-generation of heat of the heat roller based on an eddy-current loss, said fixing device comprising:

a high-frequency generating circuit which outputs a high-frequency current to generate a high-frequency magnetic field from the coil;

an electric wire which supplies the output of the high-frequency generating circuit to the coil, the electric wire being connected between the high-frequency generating circuit and the coil; and a shield member which magnetically shields the electric wire, the shield member entirely surrounding the electric wire and keeping a predetermined distance from the electric wire.

2. The device according to claim 1, wherein the shield member has a structure that does not easily generate an eddy current even when it receives a magnetic field generated from the electric wire.

3. The device according to claim 2, wherein the shield member has a cylindrical shape surrounding the electric wire and having a number of holes in its side surface.

4. The device according to claim 2, wherein the shield member has a cylindrical shape surrounding the electric wire and having a side surface made of a mesh member.

5. The device according to claim 2, wherein the shield member is made of ferrite.

6. The device according to claim 1, wherein the high-frequency generating circuit outputs a high-frequency current of a frequency other than 40 KHz.

7. The device according to claim 1, wherein the electric wire has a length shorter than a predetermined length based on a frequency of the high-frequency current output from the high-frequency generating circuit.

8. The device according to claim 1, wherein the high-frequency generating circuit comprises a rectifying circuit which rectifies an AC power source voltage and a switching circuit which converts an output voltage of the rectifying circuit to a high-frequency voltage of a predetermined frequency, the switching circuit being magnetically shielded by the shield member along with the electric wire.

9. A fixing device having a coil in a heat roller, causing the coil to generate a high-frequency magnetic field, thereby generating an eddy current in the heat roller, and fixing a developer image on a recording medium by self-generation of heat of the heat roller based on an eddy-current loss, said fixing device comprising:

a high-frequency generating circuit which outputs a high-frequency current to generate a high-frequency magnetic field from the coil, said high-frequency generating circuit comprising a rectifying circuit which rectifies an AC power source voltage and a switching circuit which converts an output voltage of the rectifying circuit to a high-frequency voltage of a predetermined frequency, the switching circuit being contained in the heat roller together with the coil.

* * * * *